US006739278B2

(12) United States Patent
Callahan

(10) Patent No.: US 6,739,278 B2
(45) Date of Patent: May 25, 2004

(54) FOLDING RIGID-BOTTOM BOAT

(76) Inventor: Steven Callahan, 61A Pine St., Ellsworth, ME (US) 04605

( * ) Notice: Subject to any disclaimer, the term of this patent is extended or adjusted under 35 U.S.C. 154(b) by 0 days.

(21) Appl. No.: 10/080,306

(22) Filed: Feb. 21, 2002

(65) Prior Publication Data

US 2002/0078877 A1 Jun. 27, 2002

Related U.S. Application Data

(63) Continuation-in-part of application No. 09/537,337, filed on Mar. 29, 2000, now Pat. No. 6,367,404.

(51) Int. Cl.[7] ..... B63B 7/00

(52) U.S. Cl. ..... 114/353; 114/354; 114/345

(58) Field of Search ..... 114/345, 352, 114/353, 354, 360, 68, 69, 123, 364; 441/40

(56) References Cited

U.S. PATENT DOCUMENTS

| | | | | | |
|---|---|---|---|---|---|
| 1,419,464 | A | | 6/1922 | Meyer | |
| 1,445,792 | A | * | 2/1923 | Olson | 114/352 |
| 2,157,186 | A | * | 5/1939 | Pinter, Sr. et al. | 114/344 |
| 2,485,446 | A | * | 10/1949 | Jackson | 114/354 |
| 2,504,256 | A | * | 4/1950 | Dittrich | 114/354 |
| 2,531,549 | A | | 11/1950 | Boyd | |
| 2,533,220 | A | * | 12/1950 | Carter | 114/353 |
| 2,577,970 | A | * | 12/1951 | Larsson et al. | 114/353 |
| 2,794,992 | A | | 6/1957 | Metzing | |
| 2,804,633 | A | | 9/1957 | Taylör et al. | |
| 3,026,839 | A | * | 3/1962 | Fridge | 114/287 |
| 3,097,371 | A | * | 7/1963 | Rough | 114/344 |
| 3,109,405 | A | * | 11/1963 | Nusinoff | 114/219 |
| 3,121,238 | A | * | 2/1964 | Levinson | 114/344 |
| 3,131,406 | A | | 5/1964 | Cousteau et al. | |
| 3,168,751 | A | | 2/1965 | Cavaignac et al. | |
| 3,170,174 | A | | 2/1965 | Hanel | |
| 3,175,234 | A | * | 3/1965 | Kutsi | 114/353 |

(List continued on next page.)

FOREIGN PATENT DOCUMENTS

| | | | | |
|---|---|---|---|---|
| AU | 0028809 | * | 5/1931 | 114/353 |
| DE | 2822182 | * | 11/1979 | 114/345 |
| EP | 0392436 A1 | * | 10/1990 | 114/353 |
| FR | 2513210 | * | 3/1983 | 114/353 |
| GB | 1571612 | * | 7/1980 | 114/353 |
| GB | 2219770 A | * | 12/1989 | B63B/7/06 |
| GB | 2317591 A | * | 4/1998 | B63B/7/00 |
| IT | 0658940 A | * | 12/1963 | 114/353 |
| SU | 0918166 | * | 4/1982 | 114/353 |
| SU | 1754568 A1 | * | 8/1992 | B63B/7/04 |

OTHER PUBLICATIONS

Cruising World; "The Proactive Emergency Craft"; by Steven Callahan; Published Dec. 1995; entire article.

(List continued on next page.)

*Primary Examiner*—S. Joseph Morano
*Assistant Examiner*—Ajay Vasudeva
(74) *Attorney, Agent, or Firm*—Adams Evans P.A.

(57) ABSTRACT

A folding rigid boat for routine and emergency use by occupants as an auxiliary watercraft and including complementary rigid bow and rigid stern sections joined together along respective mating edges to form a hull, complementary rigid hinge elements cooperating together to form a centrally-disposed joint pivotally connecting the bow and stern sections along a port-to-starboard axis in vertically spaced-apart relation to the bottom of the hull for permitting the bow and stern sections to be folded onto themselves into a storage configuration and away from each other along the joint into an unfolded use configuration. Flexible topsides are secured to the hull along at least port and starboard sides of the hull for providing an upwardly-extending freeboard to the hull when the boat is in the unfolded use configuration. The topsides are unconnected to and independent of the rigid hinge elements. Waterproofing is carried by the bow and stern sections and is unconnected to and independent of the rigid hinge elements for preventing water leakage through centrally-disposed joint when in the boat is in the unfolded use configuration.

16 Claims, 10 Drawing Sheets

U.S. PATENT DOCUMENTS

| | | | | | |
|---|---|---|---|---|---|
| 3,594,834 | A | * | 7/1971 | Steensen | 114/353 |
| 3,659,298 | A | * | 5/1972 | Edwards | 114/345 |
| 3,694,836 | A | | 10/1972 | Serra | |
| 3,724,011 | A | * | 4/1973 | Scholle | 114/353 |
| 3,834,410 | A | | 9/1974 | Leibel | |
| 3,932,906 | A | | 1/1976 | Johnson | |
| 3,950,804 | A | * | 4/1976 | Brumfield | 441/40 |
| 4,001,905 | A | | 1/1977 | Givens | |
| 4,031,580 | A | | 6/1977 | Neumann et al. | |
| 4,057,865 | A | * | 11/1977 | Trautwein | 114/347 |
| 4,180,881 | A | * | 1/1980 | Speranza | 114/344 |
| 4,216,559 | A | | 8/1980 | Switlik, Jr. | |
| 4,231,131 | A | | 11/1980 | Young | |
| 4,597,355 | A | * | 7/1986 | Kirby | 114/345 |
| 4,625,674 | A | * | 12/1986 | Covington | 114/360 |
| 4,671,202 | A | * | 6/1987 | Johnson | 114/353 |
| RE32,560 | E | | 12/1987 | Givens | |
| D293,778 | S | * | 1/1988 | Curbow | D12/317 |
| 4,730,573 | A | | 3/1988 | Koon | |
| 4,766,918 | A | | 8/1988 | Odekirk | |
| 4,807,555 | A | | 2/1989 | Hart | |
| 4,807,556 | A | | 2/1989 | Hillier | |
| 4,817,555 | A | * | 4/1989 | Meinen | 114/360 |
| 4,827,865 | A | * | 5/1989 | Yelderman | 114/353 |
| 4,942,839 | A | | 7/1990 | Chaun | |
| 4,969,413 | A | | 11/1990 | Abernethy | |
| 5,016,556 | A | | 5/1991 | Abernethy | |
| 5,070,807 | A | | 12/1991 | Lewis | |
| 5,088,434 | A | | 2/1992 | Harding | |
| 5,183,002 | A | | 2/1993 | Parker | |
| 5,299,521 | A | * | 4/1994 | Loucks | 114/219 |
| 5,317,985 | A | | 6/1994 | Shewmon | |
| 5,342,230 | A | | 8/1994 | Louis | |
| 5,353,733 | A | | 10/1994 | Evans | |
| 5,463,971 | A | | 11/1995 | Abernethy | |
| 5,515,805 | A | * | 5/1996 | Johanson | 114/344 |
| 5,800,225 | A | | 9/1998 | Shoaff, III | |
| 5,823,283 | A | | 10/1998 | Mamonov | |
| 5,868,097 | A | | 2/1999 | Spickelmire | |
| 6,145,465 | A | * | 11/2000 | Murphree | 114/353 |
| 6,343,562 | B1 | * | 2/2002 | Ingram | 114/347 |
| 6,367,404 | B1 | * | 4/2002 | Callahan | 114/353 |

OTHER PUBLICATIONS

Tinker—The Versatile Inflatables; "Tinker Fold Away RTB—The Rigid Inflatable Boat that Folds Away"; Published prior to Apr. 2, 1999; entire article.

SWITLIK; Coastal Life Raft; Published prior to Apr. 2, 1999; entire brochure.

Practical Sailor; "Offshore Life Raft Tests"; vol. 26, No. 13, Jul. 1, 2000; entire article; 4 pages.

Avon Liferafts; 3 pages, not dated.

Schoaff; "Winslow Approved Offshore Life Rafts Have the Follow"; Winslow Liferaft Company; 1 page, not dated.

SWITLIK; Life Rafts; 1 page.

The Givens Buoy Life Raft; U.S. patent Nos. 3,883,913 and 4,001,905; 3 pages.

Shewmon, Inc.; "Shewmon's Sea Anchor & Drogue Handbook"; 2 pages; copyright 1989; Shewmon, Inc.

Para–Anchors International; letter to Steven Callahan; 1 page, Sep. 25, 1990.

Hathaway, Reiser & Raymond, Inc.; "Galerider New Storm Survival System Proven in Force 12 seas!"; 2 pages.

Seabrake America, Inc.; "The Ultimate Drogue, Introducing the revolutionary New Collapsible Seabrake GP Drift Anchor & Drogue for your safety and comfort at sea"; chart; 2 pages.

* cited by examiner

FOLDING RIGID-BOTTOM BOAT

This application is a continuation-in-part of applicant's prior patent application, Ser. No. 09/537,337, filed Mar. 29, 2000 now U.S. Pat. No. 6,367,404.

TECHNICAL FIELD AND BACKGROUND OF THE INVENTION

The present invention is the result of the inventors 30 years of experience with boats, including sailing, designing, and construction, combined with his survival experience in a conventional life raft. Generally, the stability, speed potential, load-carrying capability, and resistance to shipping water from waves and spray increase with a vessel's size. Although the safety, utility, and comfort of small craft therefore increase with size, increasing size creates problems for storage and transport, especially for auxiliary craft that must be carried aboard other boats, land vehicles, or aircraft. Many mariners are forced to carry auxiliary craft far smaller than the ideal because of limitations of onboard storage space. In addition, most mariners need launches (dinghies) for normal commuting between ship and shore, while many of these mariners should also carry conventional life rafts or boats for emergencies at sea, yet available space aboard too often makes the carrying of both a dinghy and life raft or life boat difficult if not impossible. The invention, allows manners to store and/or transport in the same cubic footage a vessel roughly twice the length of a normal rigid boat, which provides roughly six to eight times the in-use volume, allowing mariners to carry significantly larger craft that enhance both routine and emergency capabilities of the craft. Alternatively, mariners may choose to carry twice as many auxiliary craft as they could by using typical rigid craft. The invention also allows boaters of every sort to more easily store or transport a wide variety of folding craft including but not limited to flat-bottomed, chined, round-bottomed, V-d, and stepped displacement and planing hulls to create dinghies, lifeboats, kayaks, canoes, barges, prams, runabouts and a host of other types with enhanced capabilities. As used herein the term "FRB" refers to "folding rigid-bottom boat."

Other inventions designed to reduce the storage and/or transport requirements of boats include inflatable boats such as folding rigid inflatable boats (FRIB), folding rigid boats, take-apart nesting rigid boats, rigid-bottomed inflatable boats (RIBs) and folding rigid-bottomed inflatable boats. The latter utilize fabric hinges closely associated with waterproofing schemes and full-width bulkheads the tops of which must be straight and positioned precisely at a height just above the rigid bottom elements and below the inflatable topsides. Inflatable boats with no rigid bottoms provide very limited speed potential in all but very light conditions except under engine power, especially poor performance under sail or oars, and poor directional control in all conditions. They are also vulnerable to total failure from a puncture or two as well as significant degradation from beaching and other sources of chafe. RIBs maintain better performance characteristics while in use and some models reduce volume when stored, but stored length always remains the same.

Folding rigid boats such as U.S. Pat. No. 4,671,202 shorten the stored length of a vessel, but they do not reduce the volume because the hinge fulcrum must rest above the uppermost extended topsides. They also require the above referenced full-width bulkheads, usually at a height equal to the uppermost extended topsides, and must be secured in an in-use position with hardware before use is possible. Take-apart boats, including rigid boats that disassemble so one part may "nest" in another, or other flexible-skinned craft that are made usable with an internal framework, can be disassembled to reduce stored volume while maintaining performance advantages in use, but they all require complicated assembly and/or full-width bulkheads. Two folding RIB designs are known (Kirby; U.S. Pat. No. 4,597,355, and the English Tinker™ folding RIB), which do reduce the volume and length of the stored vessel while maintaining performance advantages, but both are dependent upon fabric hinges that are integrated with waterproofing of the joint between bow and stern elements and inflatable uppermost topsides. Their rigid bottoms also are specified to be shallow-V-bottomed so that all applications require the inflatable tubes to rest in the water, at least through the after sections, where they are more vulnerable to chafe from beaching or other similar events. A single hole in the uppermost topsides also renders these craft virtually unusable. They also depend upon the described full-width bulkheads. Most importantly, the fabric hinges on these boats are more prone to stretch and deterioration than hinges made of rigid materials, producing a boat that is less rigid in a seaway and shorter lived than the invention. Also of primary importance, in these folding RIB designs, the hinge, waterproofing and uppermost topside tubes are connected or in very close proximity, making them fully integrated components that require closer tolerances than FRB during manufacture. The full integration of hinge, waterproofing and inflatable uppermost topsides makes disassembly of one part impossible without completely disrupting the integrity of another and for all intents and purposes, destroying it. This makes it virtually impossible to repair or replace critical components without repairing and replacing all the others. Repairs and/or improvements requiring replacement of critical parts, therefore, become more expensive and difficult than for a FRB design, and are virtually impossible except by the manufacturer.

Full-width bulkheads with straight tops in the various boat configurations noted significantly limit the possibilities for arranging the interior of the boat and prevent application to many configurations, such as kayaks in which passengers sit in a centralized position and low in the boat.

To overcome all limitations of the aforementioned boats, including other folding RIBs, a new approach was necessary which addresses separately the requirements for hinging, waterproofing, and providing sufficient buoyancy to carry a load. The invention, FRB, is unique in that these requirements are met with independent features. This, in contrast to prior boats, makes the invention more adaptable to different boat configurations that can suit the diverse needs of various mariners. It also dramatically improves the invention's long-term reliability, and facilitates quicker and less expensive repairs or improvements.

Only hinged folding boats can be deployed for use without complicated assembly, and FRB is among these few designs, but it also differs from them in significant ways.

FRB is the only RIB that benefits from the rigidity, strength, and longevity of rigid hinges, like some folding rigid boats, but unlike rigid boats, the axis of the hinge element(s) of FRB rests significantly below the uppermost extended topsides, or gunwale, when the boat is in the unfolded use condition, allowing the boat to fold into a much smaller volume as well as length.

Unlike other folding RIB designs, FRB's hinge element(s), any required waterproofing of the joint between bow and stern elements, and inflatable (or fabric skin) uppermost extension of the topsides are completely independent of and unattached to one another, with the noted exception of a small section of gasket bonded to the bottom of the uppermost flexible topsides, the components of which can be separated without destroying the mating component. This separation of functions and the devices designed to fulfill them dramatically increases the flexibility of design to suit different boat configurations, interior arrangements, hinge and waterproofing mechanisms, and manufacturing processes, and therefore its performance in any specific application. Numerous hinge styles, uppermost topside configurations and waterproofing mechanisms can be employed if desired. Optional waterproofing gaskets and membranes, may best suit designs with a need to keep mating bulkheads or frames near or below the waterline, for example. In other applications, a non-waterproofed joint combined with double-bottom with sealed or sealable compartments with sufficient volume to float the designed load are most appropriate. Such a design is highly desirable for boats designed to negotiate surf or white water where substantial water routinely enters the boat over the topsides, in which case it is desirable to drain the water as quickly as possible through the bottom. Obviously, such flexibility allows designers to optimize each design for particular uses.

Equally important, any degradation or failure of any single element has no deleterious effect on any other. If, for example, a hinge element fails, the fabric upper topsides and waterproofing of the joint remains unharmed, and vise versa. This dramatically improves the invention's reliability.

Finally, as time passes and components either require replacement or it is desirable to replace them with refined components, each can be independently replaced, unlike other folding RIBs and prior art in which hinges, waterproofing and inflatable tubes are integrated and permanently bonded together. In order to repair or replace a single component in these other designs, one must completely disrupt and virtually destroy the other key components. By separating functions, the invention allows even end-users in remote locations to repair or improve their boat. This not only increases the functional life span of the boat but it also reduces repair costs and eliminates any need to return damaged boats to the builder for repair.

Furthermore, the hinge elements can be mounted independent of any mating bulkheads or frames between said elements, again allowing greater openness and flexibility of the interior design. The topsides of the FRIB may either be composed of the typical RIB inflatable tubes, or they may be composed of "pop-up" fabric topsides supported by a collapsible, rigid-gunwale element and supporting struts.

SUMMARY OF THE INVENTION

Therefore, it is an object of the invention to provide a rigid-bottom water craft with significantly reduced volume while stored relative to its dimensions when unfolded and ready for use, while simultaneously maintaining enhanced performance characteristics such as speed, tracking, maneuverability, and stability of other rigid-bottom craft, whether powered by oar, paddle, sail, engine, kite or other means.

It is another object of the invention to provide a foldable water craft that may be adapted to the widest possible number of hull shapes and boat types to meet the needs of various types of mariners.

It is another object of the invention to provide a foldable water craft that does not require complicated assembly for use.

It is another object of the invention to provide a foldable water craft with enhanced strength, durability, and stiffness through the use of a rigid bottom and rigid hinge elements, as opposed to fabric.

It is another object of the invention to provide a foldable water craft with hinge and upper topsides components that are installed and function completely independently of one another in order to enhance their reliability, functionality, applicability to different configurations, and the cost and ease of repair, replacement, and/or upgrading of any component.

It is another object of the invention to provide a foldable water craft with optional gasket waterproofing that is completely independent of the hinge element and is only bonded to the flexible upper topsides in a relatively small area in order to enhance their reliability, functionality, applicability to different configurations, and the cost and ease of repair, replacement, and/or upgrading of any component.

These and other objects of the present invention are achieved in the preferred embodiments disclosed below by providing a folding, rigid-bottom boat for routine or emergency use, the boat including a rigid hull bottom with complementary bow and stern elements joined along common, centrally disposed joint edges and a hinge element the hinge-pin axis of which extends from port to starboard along the centrally disposed joint edges and pivotally connecting the bow and stern elements together for permitting the bow and stern elements to be folded onto themselves into a storage or transport configuration and into an unfolded, deployed or in-use configuration. The boat also includes flexible upwardly extending topsides extending around at least the sides and bow of the hull (and may enclose the entire perimeter) for providing additional upwardly extended freeboard during deployment and to further provide rigidity to the hull when the boat is in the deployed mode, while allowing the boat to fold when the uppermost topsides are collapsed.

Preferably, the hinge element is composed of a pair of conventionally styled rigid hinges positioned towards the outboard edges of the centrally disposed joint.

According to another preferred embodiment of the invention, the flexible uppermost topsides are composed of an inflatable tube composed of a waterproof, airtight fabric or film, and that can be sectioned to provide protection of its reserve buoyancy should the tube be holed.

According to another preferred embodiment of the invention, one or more sealed or sealable waterproof compartments are provided in the boat's bottom that enclose a volume that displaces a weight of water equal to or exceeding the weight of the boat in addition to the intended passengers and equipment, thereby eliminating the necessity for any waterproofing of the laterally disposed joint.

According to another preferred embodiment of the invention, the sealed or sealable waterproof compartments include hatches through which users can access at least portions of the waterproof compartment or compartment for the storage and retrieval of auxiliary equipment or supplies.

According to another preferred embodiment of the invention, a waterproofing gasket is employed to reduce or eliminate water from penetrating the centrally disposed joint to the interior of the boat. Preferably, the gasket is bonded to one mating frame or bulkhead between bow and stern elements, and stretches from port to starboard, joining the mating frames or bulkheads at their extreme outermost and uppermost points where the gasket also is bonded to the bottom side of the collapsible uppermost topsides.

According to another preferred embodiment of the invention, the waterproofing gasket is composed of dual gaskets that provide a backup waterproofing barrier should one gasket fail or become damaged.

According to another preferred embodiment of the invention, a supplemental securing mechanism secures the bow and stern elements together to further help to make rigid the boat bottom when the boat is in the unfolded use configuration.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
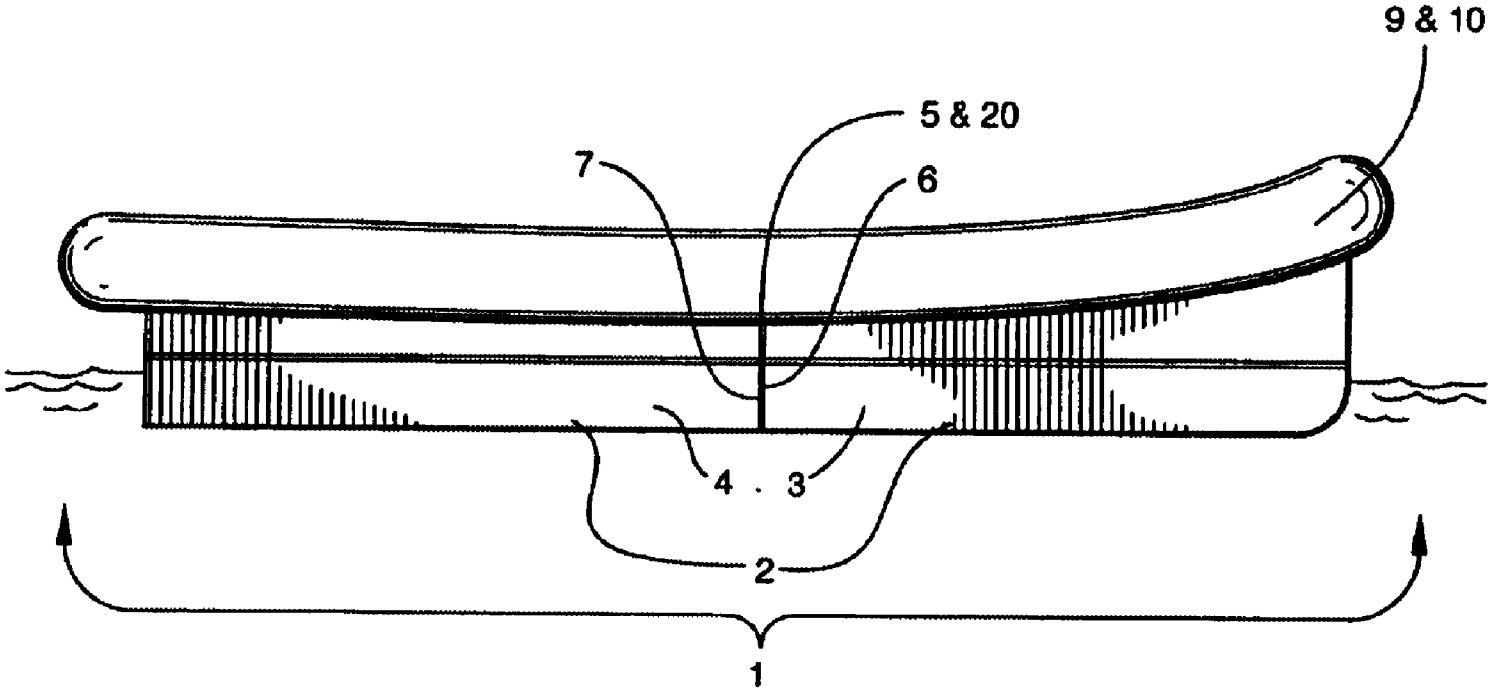
FIG. 1 is a side elevation of a preferred embodiment of the invention with inflatable uppermost topsides.
Figure 2:
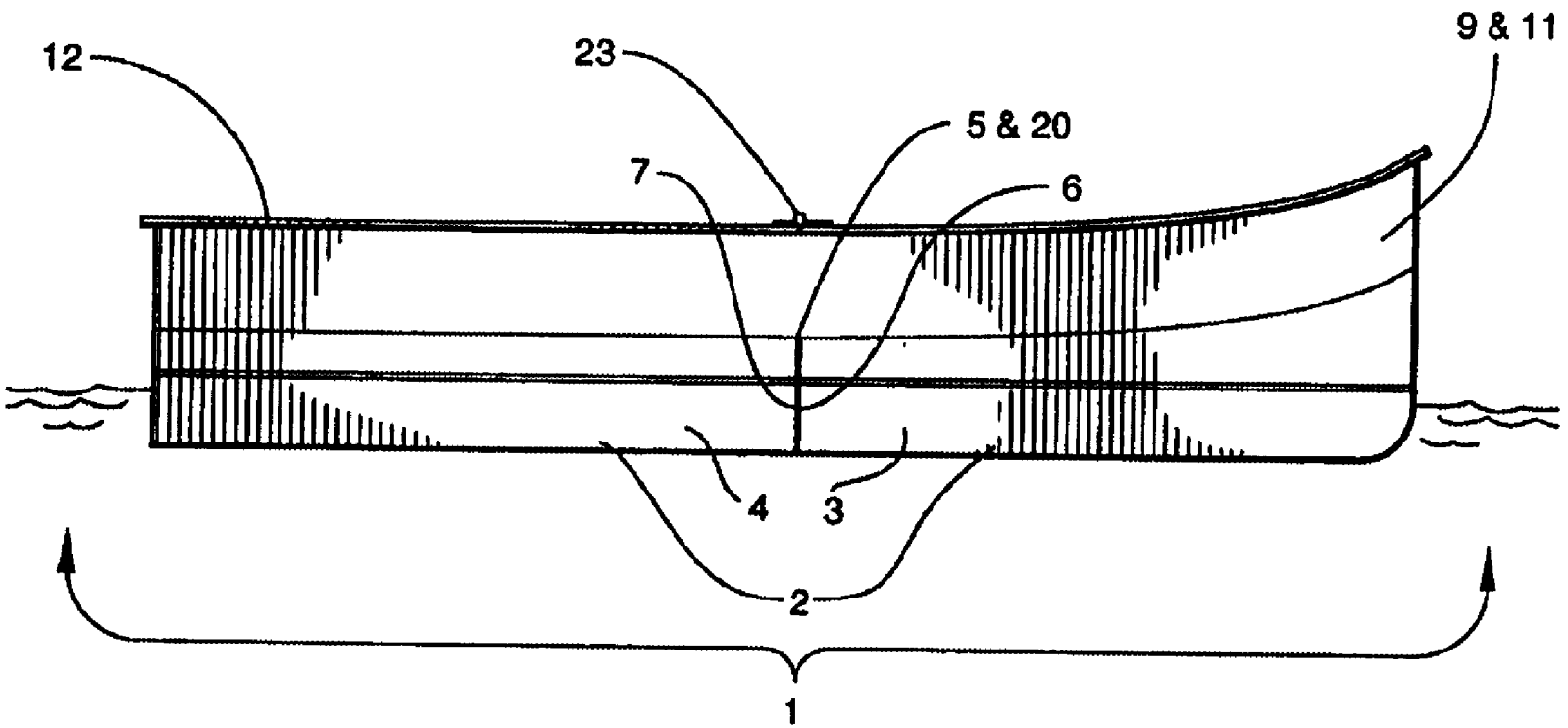
FIG. 2 is a side elevation of an optional embodiment of the invention with flexible-sheet uppermost topsides.
Figure 3:
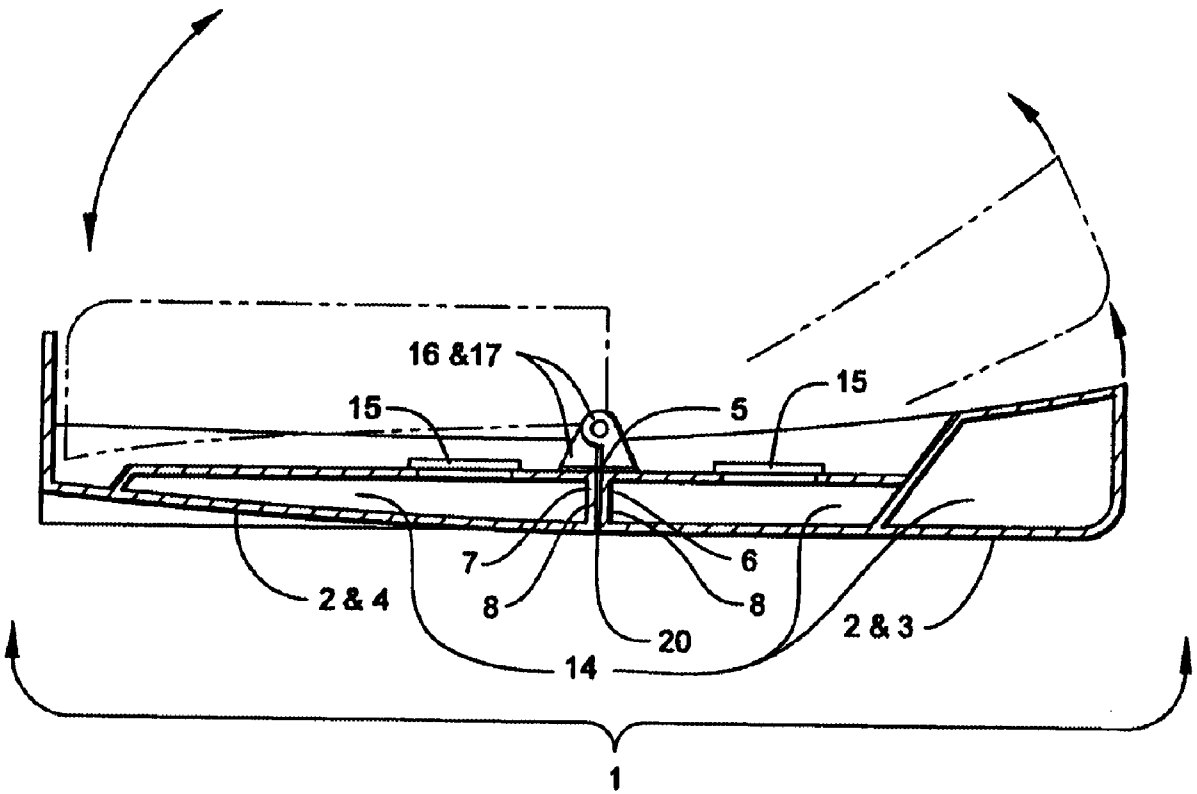
FIG. 3 is a cross-sectional view substantially along line A–A' of FIG. 4 of the hinged rigid-bottom of the invention with uppermost topsides not shown to clarify the method of folding the boat.

Referring now specifically to the drawings, the preferred embodiment of the invention is shown in FIGS. 1, 3, 4, 6*a*, 6*b*, 8, and 10. As shown in FIG. 3, the unfolded use configuration of the boat 1 is indicated by solid lines and labeled OPEN; the closed configuration for storage and transport is indicated by phantom lines and is labeled CLOSED; rotational lines along which the bow element 3 moves as the boat transitions from the OPEN to CLOSED positions are indicated by a lifted phantom bow and arrowed arcs.

As shown in FIGS. 1 through 12, the boat 1 features a rigid-bottom hull 2—i.e.; one composed of fiberglass reinforced plastic or other composite material (aramid or carbon reinforced laminates included), molded or cast PVC (polyvinylchloride) or similar plastic, wood, metal or other relatively stiff material—in order to enhance the water craft's performance while in use. The hull may be V-bottomed, round-bottomed, step-planed or otherwise shaped to be propelled by oars, paddle, sail, engine or other means.

As shown in FIGS. 1 through 5 plus 8 and 9, the hull 2 is composed of at least two elements, a bow element 3 and stern element 4 joined together along laterally disposed joint 5 with edges 6 and 7, respectively, running across the boat 1 from port to starboard and allowing one element to fold across the other after the uppermost topsides 9 are collapsed. In some designs, there may be more than one joint 5, allowing both ends of the boat to fold towards the middle. Said joint edges may be composed of bulkheads or frames 8 to adequately stiffen the joint 5 and carry waterproofing structures, but the joint edges may be composed only of the outside hull 2 when combined with the below-described waterproof compartment(s) 14.

As shown in FIGS. 1 through 12, collapsible uppermost topsides 9 are secured to and extend around at least the sides and bow of the hull 2 (the transom may extend to the uppermost topsides' full extension for some boat configurations). The uppermost topsides 9 are preferably formed of a waterproof and airtight film or fabric such as Hypalon™ or PVC film.

As shown in FIGS. 1, 4, 6, 8, 9, 10 and 11, the uppermost topsides 9 are preferably composed of an enclosed inflatable tube 10.

As shown in FIGS. 2, 5, 7, and 12, alternatively, the uppermost topsides 9 may be composed of a sheet or multiple sheets of film or fabric 11 supported by a rigid gunwale 12 that is hinged with a hinge 23 in line with the transverse joint 5, the hinge and gunwale of which are held in the in-use deployed position with struts or similar 13.

As shown in FIGS. 3 through 12, another preferred embodiment of the invention includes one or more sealed or sealable waterproof compartments 14 in the boat's bottom 2 that enclose a volume that displaces a weight of water equal to or exceeding the weight of the boat plus intended passengers and equipment, thereby eliminating the necessity for any waterproofing of the laterally disposed joint 5.

As shown in FIGS. 3 through 7, the preferred embodiment includes hatches 15 through which users can access at least portions of the waterproof compartment(s) 14 and in which auxiliary equipment may be stored.

As shown in FIGS. 3 through 12, hinge element 16 connects the bow and stern elements 3 and 4, respectively, along the joint 5, and allows them to fold for storage and transport or open for the in-use or deployed configuration. The hinge element 16 is located well below the uppermost extension of the topsides as when the boat is in its in use configuration, allowing the boat to fold into a smaller volume, unlike prior art that describes folding rigid boats with rigid topsides. The hinge element 16 also is composed of rigid structural material such as cast plastic, reinforced composites or metal with a similarly constructed hinge pin, providing a longer-lasting and structurally superior hinge less prone to environmental degradation, wear, and failure compared to fabric or other flexible hinges, and will provide more stability to the shape of the unfolded and deployed craft, especially when it is exposed to a seaway over an extended period. Furthermore, unlike prior art describing folding rigid inflatables, the hinge element 16 is fully independent of any waterproofing mechanism and the flexible uppermost topsides 9, and may be mounted independent of any mating frames or bulkheads 8, thereby reducing the complication and cost of repairing or replacing one or more of the boat's components and eliminating the failure of other components if a single component fails. The independence of the hinge element 16 also allows the use of a much wider number of hinge-style and boat configurations. The hinge-pin axes run parallel to (and in plan view, directly above) joint 5 at a position slightly above the uppermost point of the boat's bottom 2 at joint 5 (which provides a small space in which to fold the flexible topsides 9) and well below the uppermost extension of the flexible topsides 9.

Figure 7:
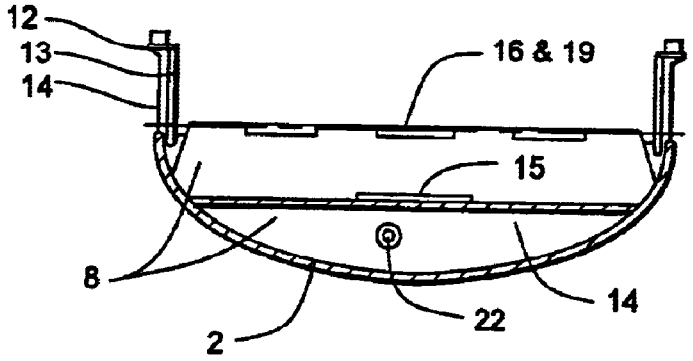
FIG. 7 is a cross-sectional midships view substantially along line C–C' of FIG. 5 showing an optional embodiment of the invention with flexible-sheet uppermost topsides, also showing an optional piano-style hinge.

As shown in FIGS. 3 through 12, the preferred configuration includes two conventionally styled rigid hinges installed in the proximity of the outboard edges of joint 5. Any pair of conventionally styled hinges style such as scissor-style hinges 17 (FIGS. 3, 4, 6*a*, and 8 through 12), butterfly-style hinges 18 (FIGS. 5 and 6*b*) that utilizes a relatively short hinge pin may be used. The hinge may be mounted to the hull 2 or other structure, such as the top of waterproof compartments 14, allowing the much reduced size or elimination of mating frames or bulkheads 8, unlike prior art, which allows the maximum number of interior configurations. As shown in FIG. 7, optionally, a single piano-style hinge 19 running along a substantial span of joint 5 may be used, and the mount of any hinge element may include mating bulkheads or frames.

Figure 4:
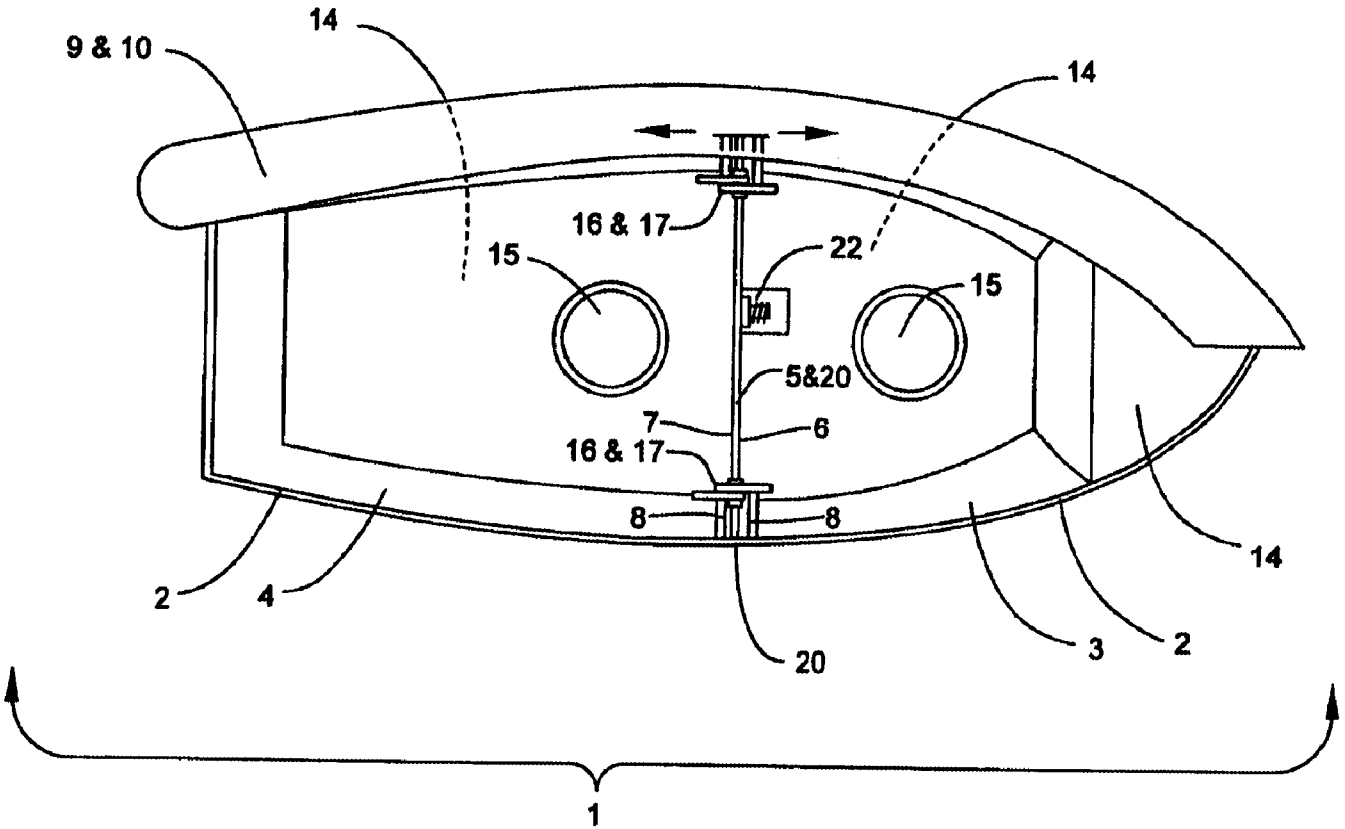
FIG. 4 is a top plan view of the invention with the preferred embodiment of inflatable uppermost topsides above and the rigid portion of the hull bottom (inflatable topsides not shown for clarity) below, plus the preferred outboard-hinge configuration utilizing scissor-like hinges.
Figure 5:
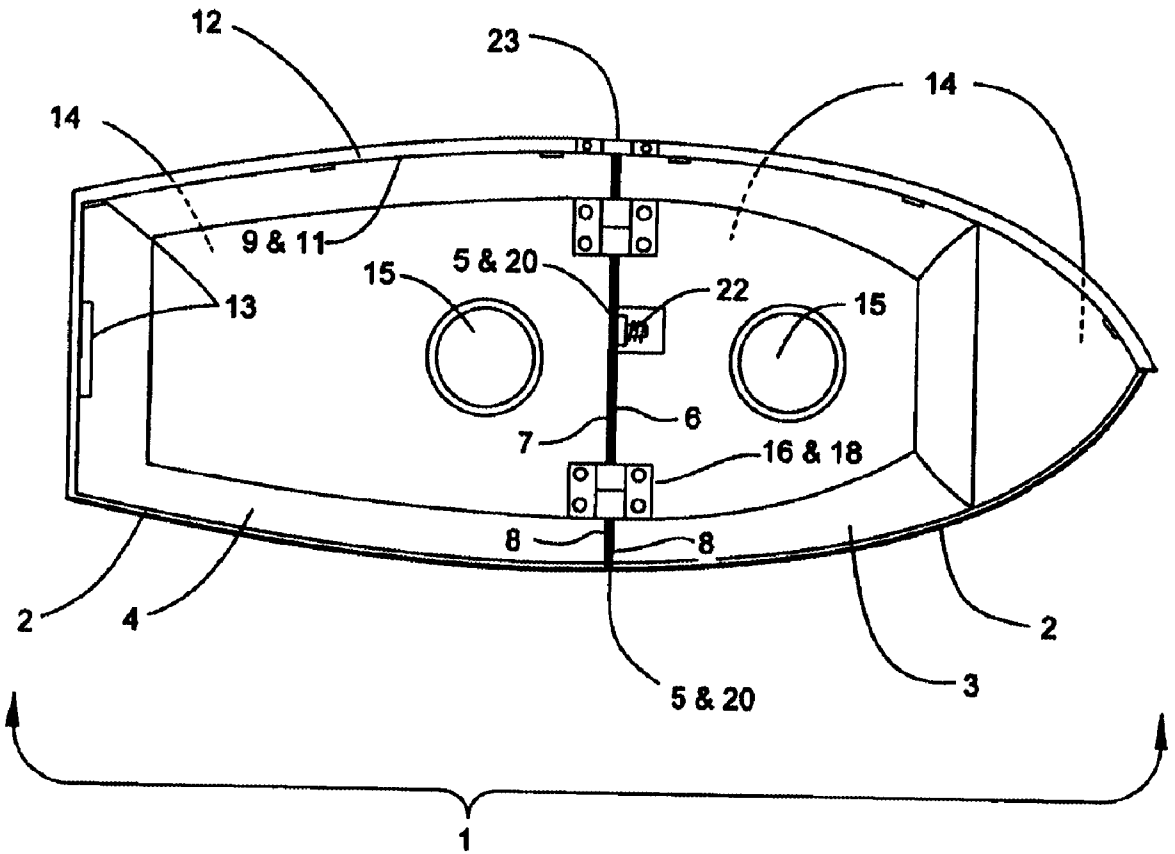
FIG. 5 is a top-plan view of the invention similar to FIG. 4 but with the optional embodiment of flexible-sheet uppermost topsides shown above and the rigid portion of the hull (flexible-sheet topsides not shown for clarity) below, plus the preferred outboard-hinge configuration utilizing butterfly-style hinges.
Figure 6A:
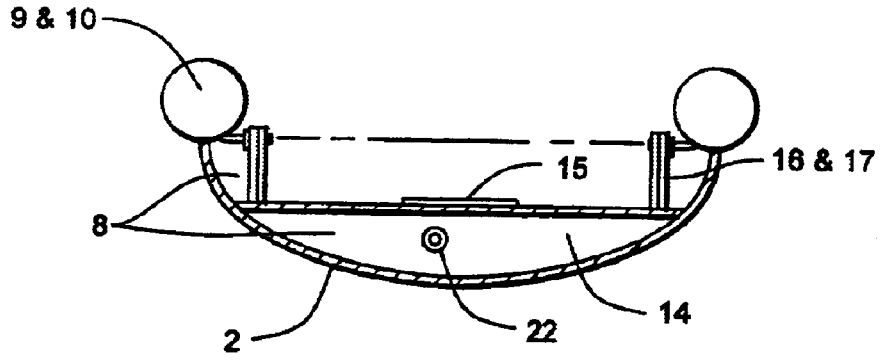
FIG. 6*a* is a cross-sectional midships view substantially along line B–B' of FIG. 4 showing a preferred embodiment of the boat with preferred outboard hinges showing scissors-style hinges.
Figure 6B:
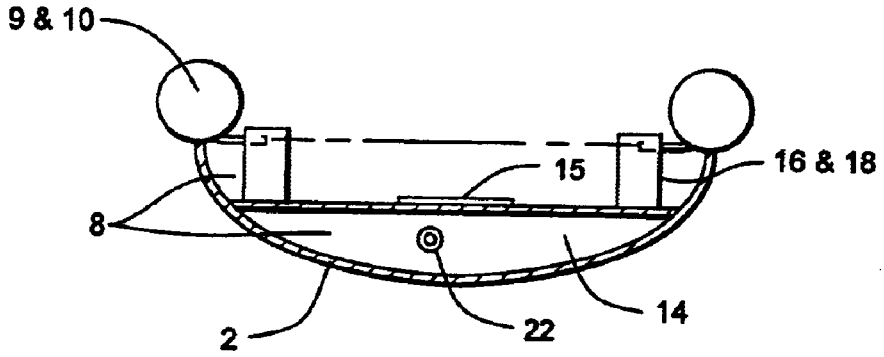
FIG. 6*b* is a cross-sectional midships view substantially along line B–B' of FIG. 4 showing a preferred embodiment of the invention with inflatable uppermost topsides and preferred outboard hinges showing butterfly-style hinges.

As shown in FIGS. 3 through 5 plus 8 through 12, a waterproofing gasket 20 is preferably employed to reduce or eliminate water from penetrating joint 5 to the interior of the boat 1. The preferred embodiment of the gasket is bonded to one mating frame or bulkhead 8 and stretches from port to starboard, joining the mating frames or bulkheads 8 at their extreme outermost and uppermost points 21 where the gasket 20 also is bonded to the bottom side of the collapsible uppermost topsides 9. The gasket 20 thereby fills the gaps between the mating frames or bulkheads 8 and between said frames or bulkheads and the collapsible uppermost topsides.

Figure 8:
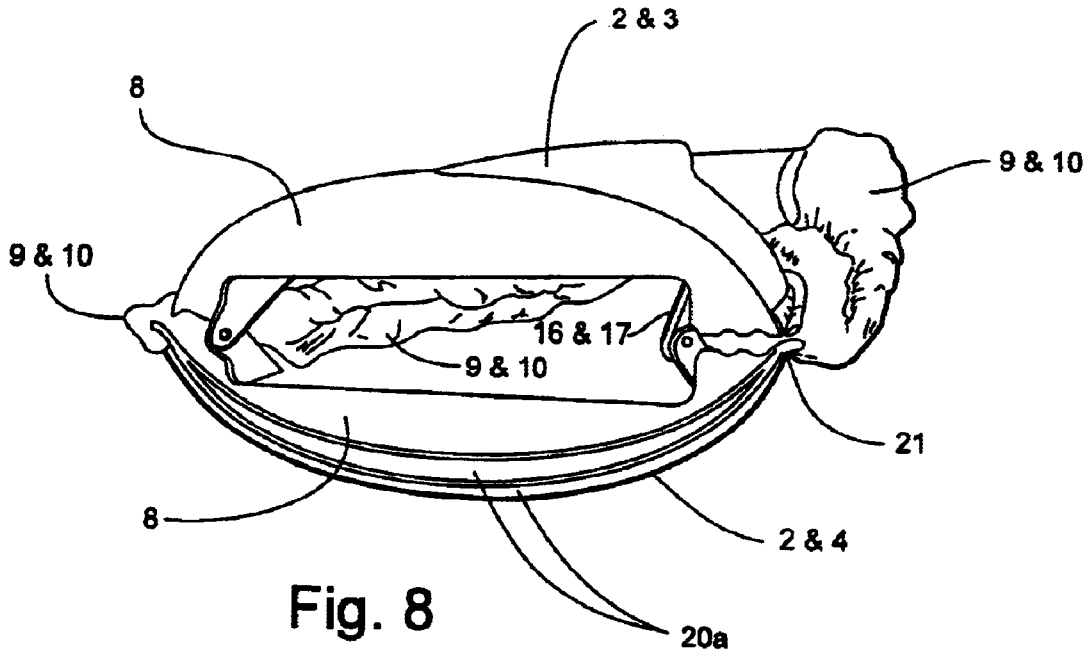
FIG. 8 is a perspective of the invention with the preferred inflatable uppermost topsides deflated and the boat in the folded configuration showing the preferred waterproofing gasket configuration.
Figure 10:
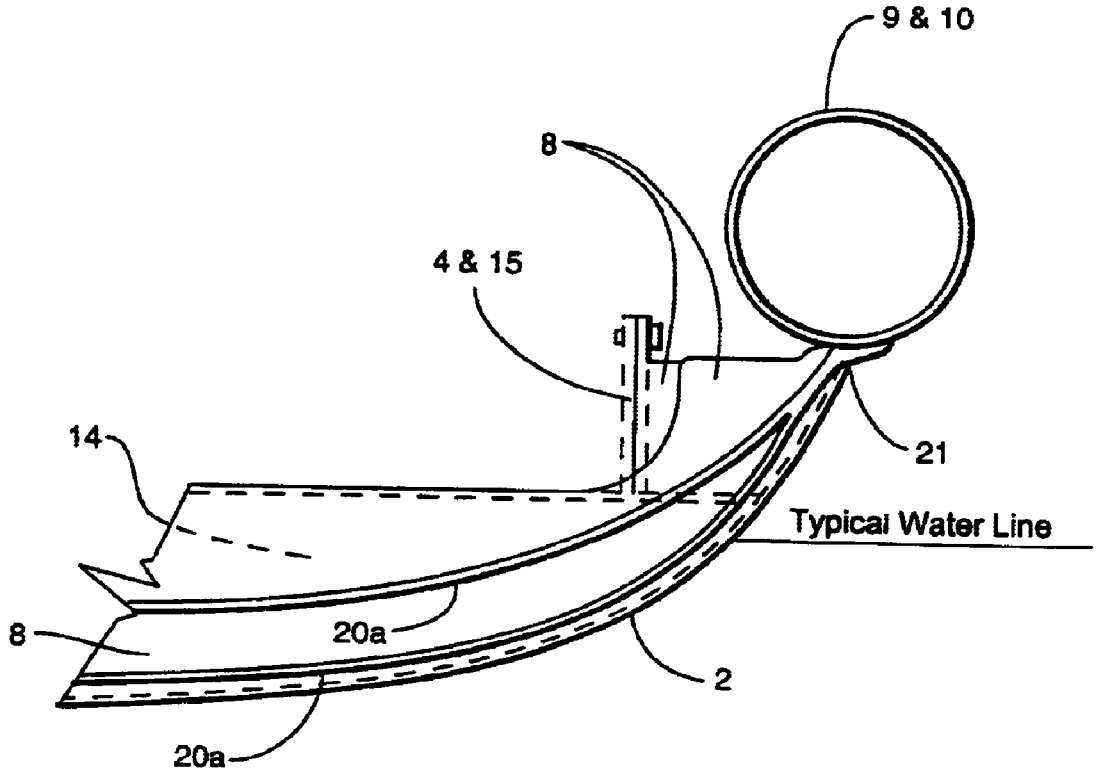
FIG. 10 is a partial cross-sectional detail view taken along line B–B' of FIG. 4 showing the preferred embodiment of inflatable uppermost topsides, outboard hinge, and waterproofing gasket configuration.

The preferred embodiment of the gasket 20*a* is shown in FIGS. 8 and 10 and includes dual gaskets forming an endless loop that provide a backup waterproofing barrier should one gasket fail or become damaged.

Figure 9:
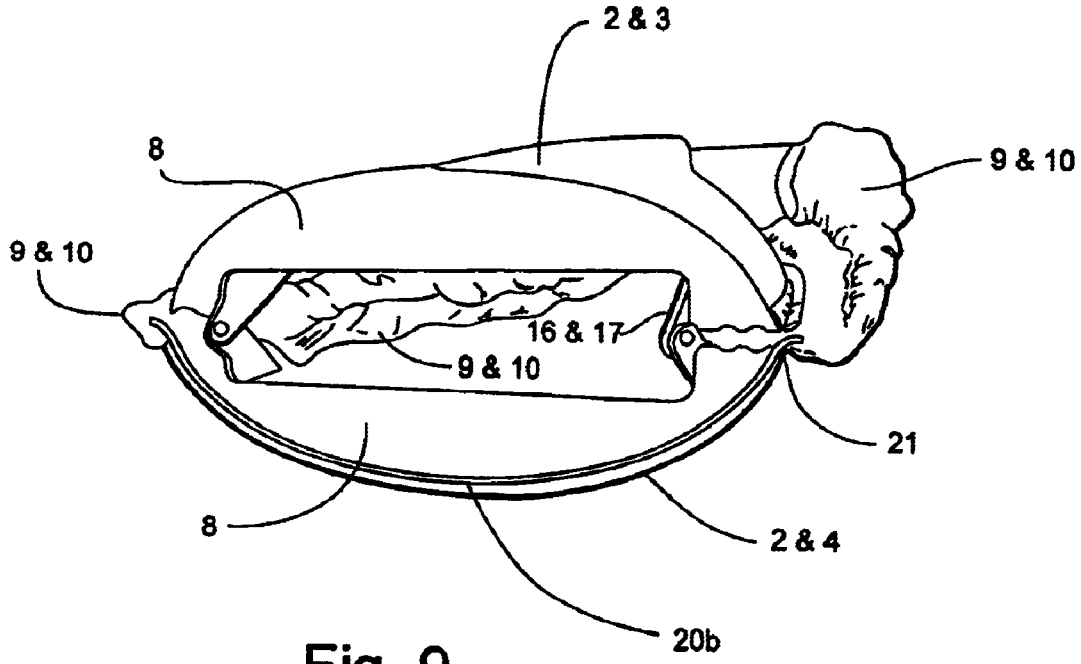
FIG. 9 is a perspective of the invention with the preferred inflatable uppermost topsides deflated and the boat in the folded configuration showing an optional waterproofing gasket configuration.
Figure 11:
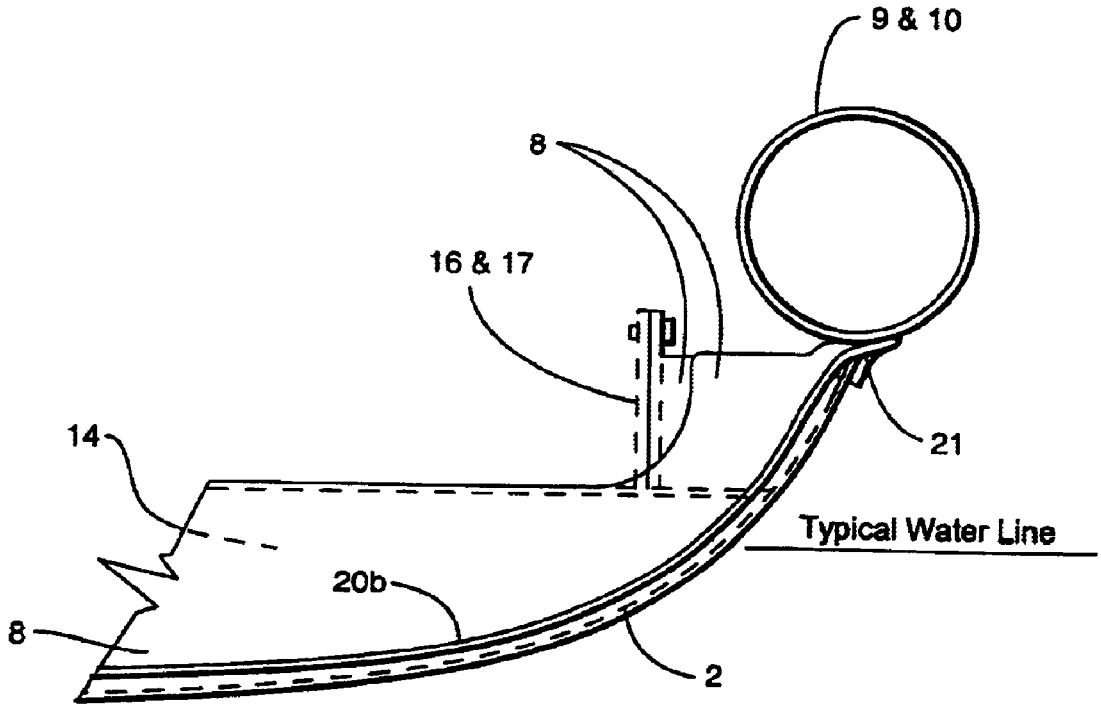
FIG. 11 is a partial cross-sectional detail view taken along line B–B' of FIG. 4 showing the preferred embodiment of inflatable uppermost topsides and outboard hinge with an optional waterproofing gasket configuration.
Figure 12:
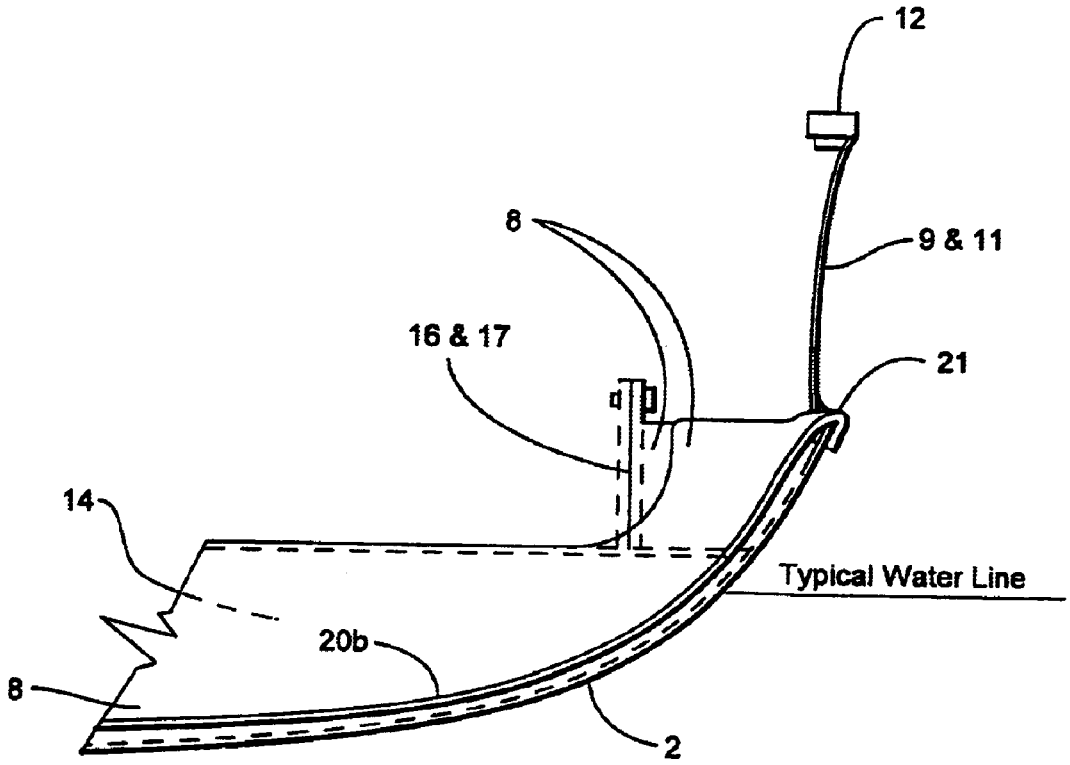
FIG. 12 is a partial cross-sectional detail view taken substantially along line C–C' of FIG. 5 showing the optional embodiment of flexible-sheet uppermost topsides and one waterproofing gasket configuration, but with scissor-style outboard hinges unlike the butterfly-style hinges shown in FIG. 5.

An alternative embodiment of the gasket 20*b* is shown in FIGS. 9, 11, and 12 and includes a single gasket to simplify construction.

As shown in FIGS. 3 and 4, the preferred embodiment includes a supplemental securing mechanism 22 to secure the bow 3 and stern 4 elements when the boat is in the unfolded use configuration. Such a mechanism may be fashioned from a threaded stud attached to the bow 3 or stern 4 element and mating nut retained by the opposite bow 3 or stern 4 element, or it may be formed using a quick-release clip or similar scheme to hold both elements 3 and 4 together when the boat is in its unfolded in-use configuration.

A boat apparatus is described above. Various details of the invention may be changed without departing from its scope. Furthermore, the foregoing description of the preferred embodiments of the invention and the best mode for practicing the invention are provided for the purpose of illustration only and not for the purpose of limitation, the invention being defined by the claims.

I claim:

1. A folding rigid-bottom boat for routine and emergency use by occupants as an auxiliary watercraft comprising:

(a) a hull comprised of complementary rigid bow and rigid stern elements including respective transversely-extending mating bulkhead elements;

(b) complementary rigid hinge elements cooperating for pivotally connecting said mating bulkhead elements together for permitting said bow and stern elements to be folded onto themselves into a storage configuration and away from each other into an unfolded use configuration, wherein said mating bulkhead elements are joined together by the complementary rigid hinge elements to form a centrally-disposed joint defining a single bulkhead extending along said joint; and (c) flexible topsides secured to said hull along at least port and starboard sides of said hull and deployable for providing a freeboard extending upwardly from the hull and for further providing rigidity to the hull when said boat is in the unfolded use configuration, wherein the flexible topsides are unconnected to and independent of the rigid hinge elements; and (d) a sole compartment sealable against water intrusion positioned in the bottom of the hull to define with the hull a double bottom, the sole compartment having a volume sufficient to displace sufficient water to keep the boat with a payload afloat in the absence of a waterproof barrier in the joint between the bow and stern elements.

2. A folding rigid boat according to claim 1, and including a membrane extending along a mating edge of the mating bulkhead elements and sealingly affixed to the bow element, stern element and adjacent topsides, thereby forming a void between said membrane and said hinge elements and defining a watertight compartment for trapping and containing leakage through said centrally-disposed joint.

3. A folding rigid-bottom boat according to claim 1, wherein the topsides comprise an enclosed elongate inflatable tube.

4. folding rigid-bottom boat according to claim 1, wherein said flexible topsides comprises a sheet material selected from the group consisting of textile fabric and plastic film and is supported by a rigid uppermost gunwale.

5. A folding rigid-bottom boat according to claim 1, and including a waterproofing gasket system, said gasket system being bonded to at least one of the bow and stern elements at the joint thereof and extending from port to starboard and sealingly engaging the other of the bow and stern elements and a bottom of the upwardly extending topsides so as to fill and waterproof the space between the flexible topsides, bow element end stern element.

6. A folding rigid-bottom boat according to claim 5, wherein the gasket system is independent of the hinge element.

7. A folding rigid-bottom boat according to claim 5, wherein said gasket system comprises first and second spaced-apart gaskets whereby water penetrating past the first gasket will be retained by the second gasket to prevent leakage into the boat from between the bow and stern elements.

8. A folding rigid-bottom boat according to claim 5, wherein said gasket system comprises an endless loop gasket defined by two spaced-apart runs of the a single length of gasket whereby water penetrating past the first gasket run will be retained by the second gasket run to prevent leakage into the boat from between the bow and stern elements.

9. A folding rigid boat for routine and emergency use by occupants as an auxiliary watercraft, comprising:

(a) complementary rigid bow and rigid stern elements joined together along respective mating edges to form a hull;

(b) complementary rigid hinge elements cooperating together to form a centrally-disposed joint pivotally connecting said bow and stern elements along a port-to-starboard axis in vertically spaced-apart relation to the bottom of the hull for permitting the bow and stern elements to be folded onto themselves into a storage configuration and away from each other along the centrally disposed joint into an unfolded use configuration;

(c) flexible topsides secured to said hull along at least port and starboard sides of the hull for providing an upwardly-extending freeboard to the hull when said boat is in the unfolded use configuration, the topsides unconnected to and independent of the rigid hinge elements for providing further rigidity to the hull; and (d) waterproofing means carried by the bow and stern elements and unconnected to and independent of the rigid hinge elements for preventing water leakage through centrally-disposed joint when the boat is in the unfolded use configuration; and (e) a sole compartment sealable against water intrusion positioned in the bottom of the hull to define with the hull a double bottom, the sole compartment having a volume sufficient to displace sufficient water to keep the boat with a payload afloat in the absence of a waterproof barrier in the joint between the bow and stern elements.

10. A folding rigid-bottom boat according to claim 9, and including a membrane extending along the centrally-disposed joint end sealingly affixed to the bow section, stern section and adjacent inflatable topsides, thereby forming a void between said membrane and said hinge elements and defining a watertight compartment for trapping and containing leakage through the centrally-disposed joint.

11. A folding rigid-bottom boat according to claim 9, wherein the topsides comprise an enclosed elongate inflatable tube.

12. A folding rigid-bottom boat according to claim 9, wherein said flexible topside comprises a sheet material selected from the group consisting of textile fabric and plastic film.

13. A folding rigid-bottom boat according to claim 9, wherein said waterproofing means comprises a gasket system bonded to at least one of the bow and stern elements at the joint thereof and extending from port to starboard and sealingly engaging the other of the bow and stern elements and a bottom of the upwardly extending topsides so as to fill and waterproof the space between the flexible topsides, bow element and stern element.

14. A folding rigid-bottom boat according to claim 13, wherein the gasket system is independent of the hinge element.

15. A folding rigid-bottom boat according to claim 13, wherein said gasket system comprises first and second spaced-apart gaskets whereby water penetrating past the first gasket will be retained by the second gasket to prevent leakage into the boat from between the bow and stern elements.

16. A folding rigid-bottom boat according to claim 13, wherein said gasket system comprises an endless loop gasket defined by two spaced-apart runs of the a single length of gasket whereby water penetrating past the first gasket run will be retained by the second gasket run to prevent leakage into the boat from between the bow and stern elements.

* * * * *